US005553474A

United States Patent [19]

Nokajima et al.

[11] Patent Number: 5,553,474

[45] Date of Patent: Sep. 10, 1996

[54] APPARATUS FOR SHAPING SUPERPLASTIC METAL WORKPIECE

[75] Inventors: Kunio Nokajima; Shizuo Kimura; Yasuo Hashimoto; Makoto Urano, all of Sayama, Japan

[73] Assignee: Honda Giken Kogyo Kabushiki Kaisha, Tokyo, Japan

[21] Appl. No.: 402,059

[22] Filed: Mar. 10, 1995

[30] Foreign Application Priority Data

Mar. 30, 1994 [JP] Japan ..... 6-060815

[51] Int. Cl.[6] ..... B21D 26/02

[52] U.S. Cl. ..... 72/60; 72/342.7; 72/54

[58] Field of Search ..... 72/54, 57, 60, 72/63, 709, 342.1, 342.7, 342.92; 29/421.1

[56] References Cited

U.S. PATENT DOCUMENTS

| | | | |
|---|---|---|---|
| 2,385,083 | 9/1945 | Kemerer | 72/60 |
| 3,974,673 | 8/1976 | Fosness et al. | 72/60 |
| 4,117,970 | 10/1978 | Hamilton et al. | 72/63 |
| 4,691,857 | 9/1987 | Friedman | 72/63 |
| 4,936,128 | 6/1990 | Story et al. | 72/60 |

FOREIGN PATENT DOCUMENTS

| | | | |
|---|---|---|---|
| 0197021 | 8/1989 | Japan | 72/60 |
| 2-87513 | 7/1990 | Japan . | |
| 0197712 | 12/1977 | U.S.S.R. | 72/60 |
| 0749498 | 7/1980 | U.S.S.R. | 72/60 |

*Primary Examiner*—David Jones

*Attorney, Agent, or Firm*—Birch, Stewart, Kolasch & Birch, LLP

[57] ABSTRACT

An apparatus for shaping a workpiece of a super-plastic metal has a shaping die assembly for holding the workpiece therein to shape the workpiece with a pressurized gas while the workpiece is being heated, and a furnace assembly surrounding outer surfaces of the dies. The shaping die assembly includes a plurality of dies separable from and joinable to each other, the dies having flanges extending from mating surfaces thereof. The furnace assembly includes a plurality of furnaces separable from and joinable to each other, the furnaces being detachably mounted on the dies, respectively. The shaping die assembly is housed in the furnace assembly with the flanges projecting out of the furnace assembly when the dies are joined to each other. Heaters for heating the shaping die assembly are mounted on inner wall surfaces of the furnaces in a space defined between the furnace assembly and the shaping die assembly. While the workpiece is being held between the dies which are joined to each other, the flanges are gripped by clamping mechanisms.

5 Claims, 2 Drawing Sheets

APPARATUS FOR SHAPING SUPERPLASTIC METAL WORKPIECE

BACKGROUND OF THE INVENTION

1. Field of the Invention

The present invention relates to an apparatus for shaping a workpiece of a superplastic metal through superplastic deformation with a pressurized gas while the plate is being heated.

2. Description of the Prior Art

One known apparatus for shaping a superplastic metal plate is disclosed in Japanese laid-open utility model publication No. 2-87513, for example.

The disclosed shaping apparatus has an upper shaping die and a lower shaping die which hold a superplastic metal plate therebetween. The superplastic metal plate between the upper and lower shaping dies is heated by heaters that are embedded respectively in the upper and lower shaping dies. While the superplastic metal plate is being thus heated a pressurized gas is introduced into a cavity defined in the upper and lower shaping dies, thereby deforming the superplastic metal plate to a desired shape along a shaping surface of the cavity.

However, since the heaters are embedded in the upper and lower shaping dies, the upper and lower shaping dies are required to be thick enough to be durable for increased mechanical strength. Consequently, the upper and lower shaping dies are necessarily large in size, and so are a device for clamping the upper and lower shaping dies (i.e., a device for vertically moving the upper die), the heaters, and thermally insulating members for preventing the upper and lower shaping dies from radiating heat.

When shaped products of a different type or configuration are to be produced, the large shaping dies need to be replaced with corresponding shaping dies, and the heaters and the thermally insulating members also need to be replaced with corresponding heaters and thermally insulating members. Therefore, the conventional shaping apparatus is relatively expensive to manufacture and costly to operate.

SUMMARY OF THE INVENTION

It is therefore an object of the present invention to provide an improved apparatus for shaping a superplastic metal workpiece, which has relatively small shaping dies and device for clamping the shaping dies, and can easily and inexpensively be adapted to different types and configurations of shaped products.

To achieve the above object, there is provided in accordance with the present invention an apparatus for shaping a workpiece of a superplastic metal, comprising a shaping die assembly for holding the workpiece therein to shape the workpiece with a pressurized gas while the workpiece is being heated, the shaping die assembly comprising a plurality of dies separable from and joinable to each other, the dies having flanges extending from mating surfaces thereof, a furnace assembly surrounding outer surfaces of the dies, the furnace assembly comprising a plurality of furnaces separable from and joinable to each other, the furnaces being detachably mounted on the dies, respectively, the shaping die assembly being housed in the furnace assembly with the flanges projecting out of the furnace assembly when the dies are joined to each other, heating means for heating the shaping die assembly, the heating means being mounted on inner wall surfaces of the furnaces in a space defined between the furnace assembly and the shaping die assembly, and clamping means for gripping the flanges while the workpiece is being held between the dies which are joined to each other.

For shaping the workpiece, the workpiece is held between the dies and then the dies are joined into the shaping die assembly, so that the workpiece is set in the shaping die assembly. At the same time, the furnaces mounted on the respective dies are joined into the furnace assembly, with the flanges projecting from the dies out of the furnace assembly in which the die assembly is housed. The flanges are gripped by the clamping means to hold the dies hermetically joined to each other. Then, the shaping die assembly and the workpiece are heated by the heating means, and a pressurized gas is introduced into the shaping die assembly to deform the workpiece to a desired shape.

Because the shaping die assembly and the furnace assembly for heating the shaping die assembly and the workpiece are essentially separate from each other, and the heating means are mounted on the inner wall surfaces of the furnace assembly, no other heating means are required to be mounted in the shaping die assembly, and the shaping die assembly can thus be reduced in size. Since the shaping die assembly can thus be reduced in size, the flanges can also be reduced in size, and hence the clamping means for gripping the flanges to clamp the shaping die assembly can also be reduced in size. The furnaces mounted on the respective dies of the shaping die assembly may be lighter than the dies, so that mechanisms for joining and separating the dies and the furnaces can be of a relatively small size. The furnace assembly is composed of the furnaces mounted respectively on the dies. Consequently, when a product of a different type or shape is to be shaped by the apparatus, only the shaping die assembly needs to be replaced with a corresponding flanged shaping die assembly, and such a corresponding flanged shaping die assembly can be clamped by the existing clamping means.

The clamping means may grip the flanges through thermally insulating members. When the flanges are gripped by the clamping means through thermally insulating members, the heat is prevented from being radiated from the shaping die assembly toward the clamping means, and hence the shaping die assembly can efficiently be heated.

The inner wall surfaces of the furnaces may comprise thermally insulating members. The inner wall surfaces of the furnaces composed of such thermally insulating members allow the shaping die assembly to be heated efficiently, and also permits the furnace assembly to be of a reduced thickness and a reduced size.

The clamping means may comprise a pair of openable and closable hands movable toward and away from the flanges projecting out of the furnace assembly when the dies are joined to each other, advancing/retracting means for moving the hands toward the flanges, and opening/closing means for closing the hands to grip the flanges when the hands are moved toward the flanges into a position in which to grip the flanges therebetween.

If the dies include a pair of lower dies which are horizontally separable away from and joinable to each other, and an upper die which is vertically separable away from and joinable to the lower dies, then the apparatus may further comprise lower die actuating means for horizontally moving at least one of the lower dies together with the furnace which is mounted on the at least one of the lower dies until the lower dies are separated from or joined to each other, and upper die actuating means for vertically moving the upper die together with the furnace which is mounted on the upper die toward the lower dies until the upper die and the lower dies are separated from or joined to each other.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
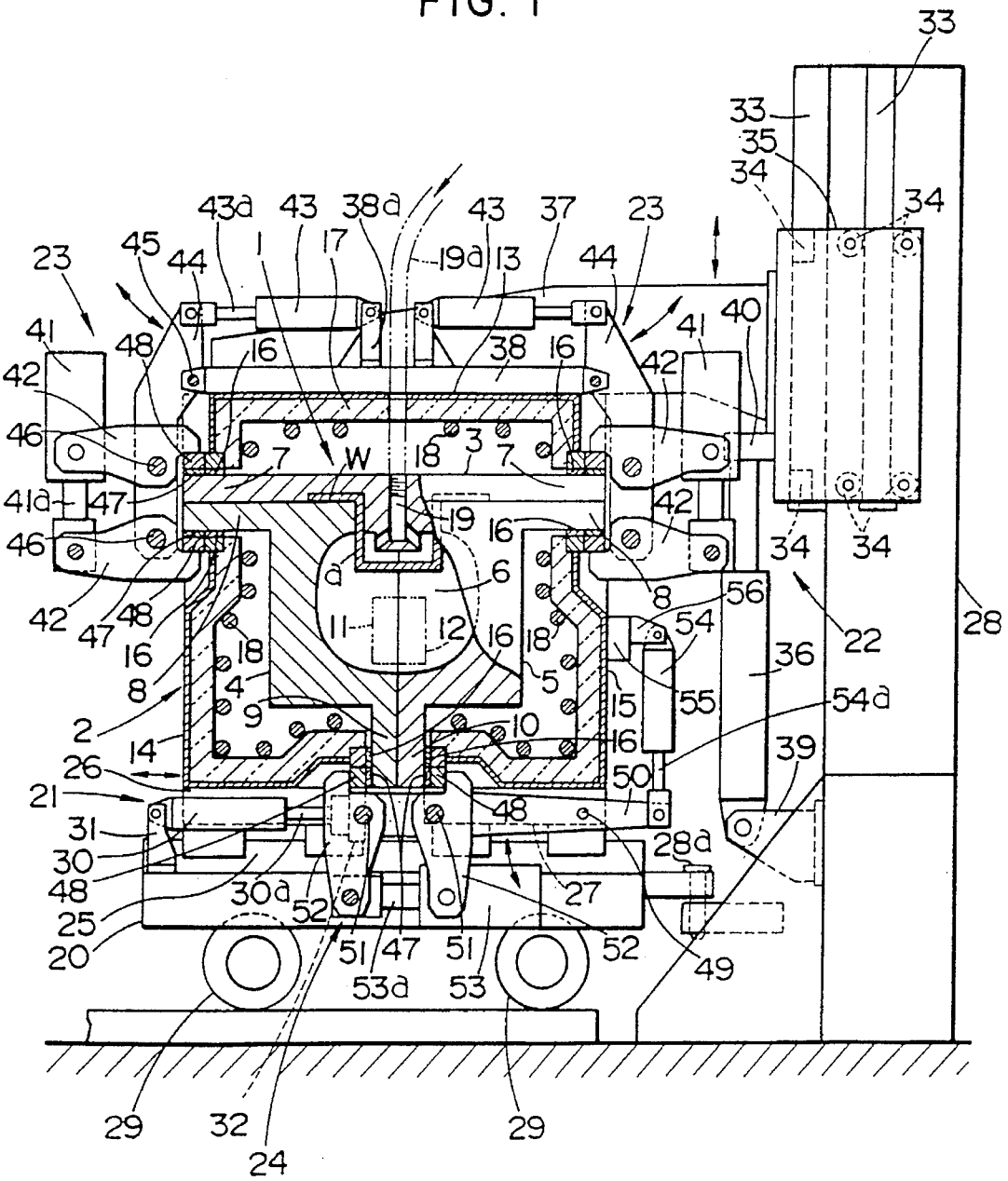
FIG. 1 is a vertical cross-sectional view of an apparatus for shaping a superplastic metal plate according to the present invention.

As shown in FIG. 1, an apparatus for shaping a superplastic metal workpiece W according to the present invention has a shaping die assembly 1 and a furnace assembly 2.

Figure 2:
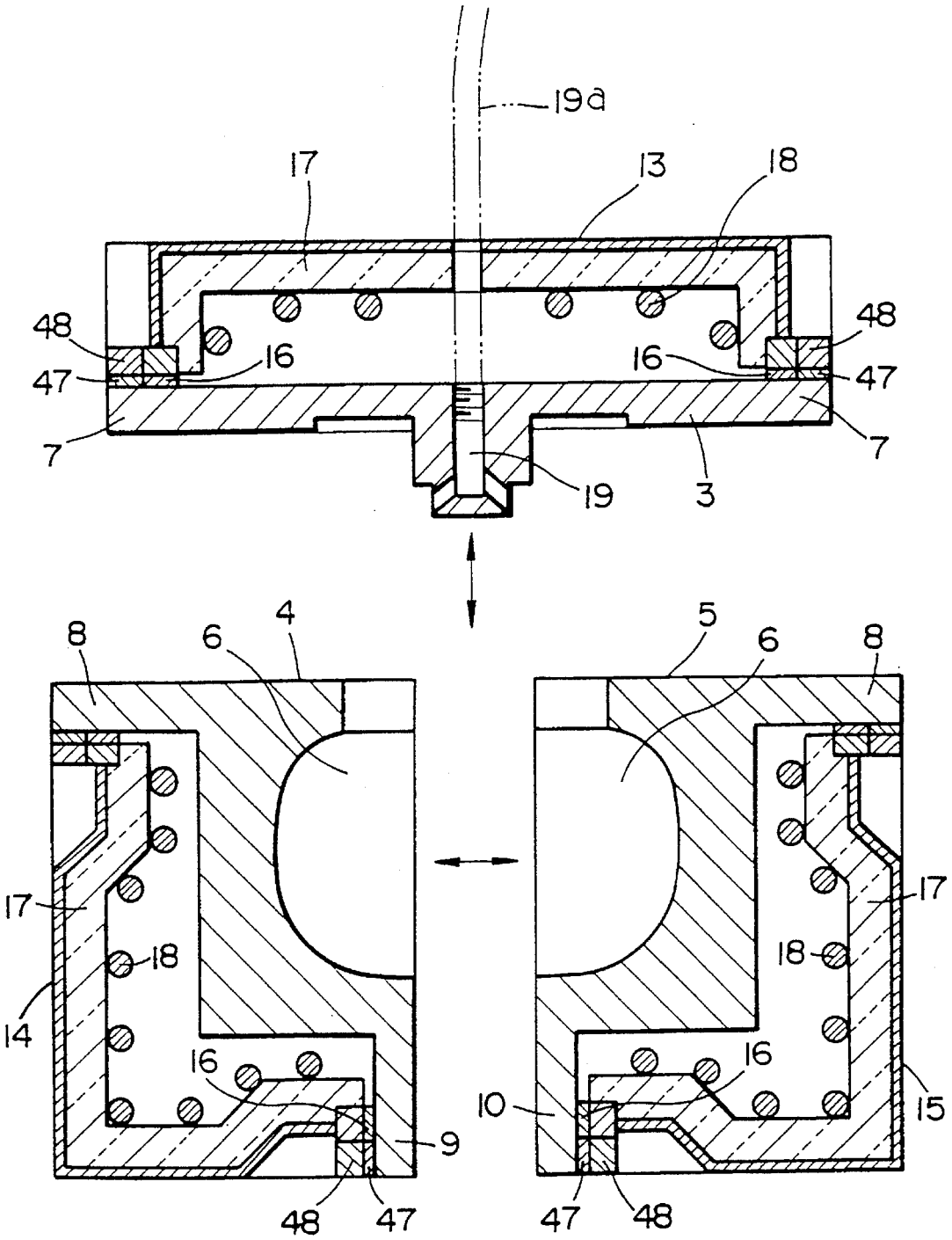
FIG. 2 is an exploded vertical cross-sectional view of a shaping die assembly and a furnace assembly of the apparatus shown in FIG. 1.

As shown in FIG. 2, the shaping die assembly 1 comprises three separable shaping dies including an upper die 3, a left lower die 4, and a right lower die 5. The lower dies 4, 5 can horizontally be joined to and separated from each other, and the upper die 3 can vertically be joined to and separated from the lower dies 4, 5. The upper die 3 and the lower dies 4, 5 are shown as being joined to each other in FIG. 1, and separated from each other in FIG. 2. When the upper die 3 and the lower dies 4, 5 are joined to each other, the lower dies 4, 5 define a cavity 6 therebetween for producing a shaped product from the superplastic metal workpiece W. The superplastic metal workpiece W has a hollow downward boss "a" formed centrally thereon, and for shaping the superplastic metal workpiece W, the downward boss "a" is inserted into the cavity 6 between the joined lower dies 4, 5 with opposite sides of the superplastic metal workpiece W being supported on respective upper surfaces of the lower dies 4, 5 which serve as mating surfaces with the upper die 3. The upper die 3 is then lowered into mating engagement with the lower dies 4, 5, thus holding the superplastic metal workpiece W between the upper die 3 and the lower dies 4, 5.

The upper die 3 has a plurality of flanges 7 extending horizontally outwardly from its upper peripheral edge, and the lower dies 4, 5 have a plurality of flanges 8 extending horizontally outwardly from their upper peripheral edges in underlying relation to the flanges 7. These flanges 7, 8 are joined to each other when the upper die 3 and the lower dies 4, 5 are joined to each other.

The lower dies 4, 5 also have respective flanges 9, 10 extending downwardly from their lower mating surfaces. The flanges 9, 10 are joined to each other when the lower dies 4, 5 are joined to each other. The lower dies 4, 5 further have respective flanges 11, 12 (indicated by the imaginary lines in FIG. 1) extending horizontally from their side mating surfaces.

The furnace assembly 2 comprises three separable furnaces including an upper furnace 13 mounted on an upper surface of the upper die 3, a left lower furnace 14 mounted on an outer side surface of the left lower die 4, and a right lower furnace 15 mounted on an outer side surface of the right lower die 5.

The upper furnace 13 is shaped to cover substantially the entire upper surface of the upper die 3, and is connected to proximal ends of the flanges 7 through thermally insulating members 16. The upper furnace 13 is detachably fastened to the upper die 3 by bolts or the like (not shown). The upper furnace 13 has an inner wall surface lined with a complementary thermally insulating member 17. A plurality of heaters (heating means) 18 are mounted on the thermally insulating member 17 in a space which is defined between the thermally insulating member 17 and the upper surface of the upper die 3.

Similarly, the lower furnaces 14, 15 are shaped to cover substantially the entire outer side surfaces of the lower dies 4, 5, respectively, and detachably fastened to proximal ends of the flanges 9, 10 through thermally insulating members 16. The lower furnaces 14, 15 have inner wall surfaces lined with complementary thermally insulating members 17, respectively. A plurality of heaters 18 are mounted on the thermally insulating members 17 in spaces which are defined between the thermally insulating members 17 and the outer side surfaces of the lower dies 4, 5.

When the upper die 3 and the lower dies 4, 5 are joined to each other, the furnace assembly 2 is of a substantially box shape surrounding substantially the entire outer surfaces of the shaping die assembly 1. At this time, the flanges 9, 10, 11, 12 have distal ends projecting outwardly of the furnace assembly 2, and edge portions of the upper and lower furnaces 13, 14, 15 except the flanges 9, 10, 11, 12 are joined through thermally insulating members 16.

The upper die 3 has a gas inlet hole 19 defined centrally therein for introducing a pressurized gas to deform the boss "a" of the superplastic metal workpiece W. The gas inlet hole 19 extends downwardly from the upper surface of the upper die 3 and has a lower open end which will be positioned in the boss "a" of the superplastic metal workpiece W when it is set in the cavity 6 in the shaping die assembly 1. The gas inlet hole 19 is connected to a pressurized gas supply pipe **19*a* extending downwardly through the upper furnace 13 from above the furnace assembly 2**.

An actuator mechanism for assembling and disassembling the shaping die assembly 1 and the furnace assembly 2 in a process of shaping the superplastic metal workpiece W will be described below with reference to FIG. 1.

The actuator mechanism includes a carriage 20 which supports the lower furnaces 14, 15 thereon, a moving means (lower die actuating means) 21 for joining and separating the set of the left lower furnace 14 and the left lower die 4 and the set of the right lower furnace 15 and the right lower die 5, a lifting/lowering means (upper die actuating means) 22 for lifting and lowering the upper die 3 and the upper furnace 13, a pair of clamping means 23 for clamping the sets of the flanges 7, 8 when the upper die 3 and the lower dies 4, 5 are joined to each other, and a clamping means 24 for clamping the sets of the flanges 9, 10 when the lower dies 4, 5 are joined to each other.

Horizontal guide rails 25 are mounted on an upper surface of the carriage 20, and the lower furnaces 14, 15 are supported through respective frames 26, 27 fixed to lower surfaces thereof for horizontal movement along the guide rails 25. The right lower furnace 15 is held in a right-hand position on the guide rails 25 by a stopper (not shown). The carriage 20 has casters 29 on its lower surface for movement toward a vertical post 28 located on the right-hand side of the carriage 20. In FIG. 1, the carriage 20 is shown as being coupled to the post 28 by a connecting pin **28*a***.

The moving means 21 comprises a cylinder 30 mounted on a left portion of the carriage 20 and having an axis parallel to the guide rails 25. The cylinder 30 has a rear end pivotally joined to a bracket 31 fixed to the carriage 20 and a piston rod 30*a* connected to a joint 32 secured to the frame 26 of the left lower furnace 14. When the piston rod 30*a* is extended, the moving means 21 moves the left lower furnace 14 together with the left lower die 4 on the guide rails 25 toward the right lower furnace 15 and the right lower die 5 until they are joined together. When the piston rod 30*a* is contracted, the moving means 21 separate the lower furnaces 14, 15 away from each other and also separate the lower dies 4, 5 away from each other.

The lifting/lowering means 22 comprises a plurality of vertical guide rails 33 mounted on an upper side surface of the post 28, a block 35 vertically movably mounted on the guide rails 33 by rollers 34, and a cylinder 36 for vertically moving the block 35 along the guide rails 33. A joint arm 37 extends horizontally from the block 35 toward an upper surface of the upper furnace 13 and is coupled to a frame 38 fixedly mounted on the upper surface of the upper furnace 13. The cylinder 36 has a vertical axis and is disposed between the furnace assembly 2 and the post 28. The cylinder 36 has a lower rear end pivotally joined to a bracket 39 fixed to the post 28 and a piston rod 36*a* coupled to the block 35 through a joint 40.

When the piston rod 36*a* is extended, the lifting/lowering means 22 elevates the upper furnace 13 together with the upper die 3 through the block 35 for thereby separating the upper furnace 13 and the upper die 3 away from the lower furnaces 14, 15 and the lower dies 4, 5, respectively. When the piston rod 36*a* is contracted, the lifting/lowering means 22 lowers the upper furnace 13 and the upper die 3 toward the lower furnaces 14, 15 and the lower dies 4, 5 until they are joined to each other.

The clamping means 23 are disposed in the respective sets of the flanges 7, 8 of the upper die 3 and the lower dies 4, 5 and are of an identical structure. The clamping means 23 for clamping the left set of the flanges 7, 8, for example, will be described in detail below. The clamping means 23 comprises an opening/closing cylinder (opening/closing means) 41, a pair of hands 42 movable toward and away from each other (closable and openable) by the cylinder 41, and a swinging cylinder (advancing/retracting means) 43 for swinging the opening/closing cylinder 41 and the hands 42.

The swinging cylinder 43 has a horizontal axis and is mounted on an upper left surface of the upper furnace 13. The swinging cylinder 43 has a right rear end pivotally joined to a bracket 38*a* vertically mounted on the frame 38 and a piston rod 43*a* pivotally coupled to a swinging arm 44 which extends substantially vertically from above an upper left corner of the upper furnace 13 toward a position laterally of the flanges 7, 8. The swinging arm 44 has an intermediate portion pivotally joined to a pivot shaft 45 mounted on a left end of the frame 38, so that the swinging arm 44 is angularly movable about the pivot shaft 45. When the piston rod 43*a* is extended, a portion of the swinging arm 44 below the pivot shaft 45 moves toward the flanges 7, 8 from their left, and when the piston rod 43*a* is contracted, the portion of the swinging arm 44 below the pivot shaft 45 moves away from the flanges 7, 8.

The hands 42, which are vertically spaced from each other and positioned laterally of the flanges 7, 8, have respective intermediate portions pivotally coupled to the portion of the swinging arm 44 below the pivot shaft 45 by respective pivot shafts 46. The hands 42 have respective left rear ends pivotally joined respectively to a cylinder casing of the opening/closing cylinder 41 and a piston rod 41*a* thereof. Therefore, when the piston rod 41*a* is contracted or extended, right distal ends of the hands 42 are angularly moved away from or toward each other (opened or closed) about the pivot shafts 46. When the swinging arm 44 swings, the hands 42 and the opening/closing cylinder 41 move toward and away from the flanges 7, 8. The right distal ends of the hands 42 are positioned upwardly and downwardly of the flanges 7, 8 when the swinging arm 44 is angularly moved to displace its portion below the pivot shaft 45 toward the flanges 7, 8. With the right distal ends of the hands 42 are positioned upwardly and downwardly of the flanges 7, 8, when the right distal ends of the hands 42 are moved toward each other or closed by the opening/closing cylinder 41, the flanges 7, 8 are gripped or clamped by and between the right distal ends of the hands 42. Specifically, clamp seats 48 (see also FIG. 2) are fixed through thermally insulating members 47 to distal ends of the flanges 7, 8, and therefore, the right distal ends of the hands 42 grip the flanges 7, 8 through the thermally insulating members 47 and the clamp seats 48.

The clamping means 23 for clamping the right set of flanges 7, 8 is also of the same structure, described above, as the clamping means 23 for clamping the left set of flanges 7, 8. Therefore, the left and right sets of flanges 7, 8 are gripped by the respective clamping means 23.

The clamping means 24 for clamping the flanges 9, 10 on the lower ends of the lower dies 4, 5 comprises a swinging arm 50 extending horizontally below the lower furnaces 14, 15 and having an intermediate portion pivotally joined to the frame 27 by a pivot shaft 49, a pair of hands 52 pivotally joined at their intermediate portions by respective pivot shafts 51 to a left distal end portion of the swinging arm 50 which is positioned underneath the flanges 9, 10, an opening/closing cylinder (opening/closing means) 53 for angularly moving (opening and closing) the hands 52, and a swinging cylinder (advancing/retracting means) 54 for angularly moving the swinging arm 50 to move the hands 52 toward and away from the flanges 9, 10. The hands 52 have respective lower rear ends pivotally coupled respectively to a cylinder casing of the opening/closing cylinder 53 and a piston rod 53*a* thereof. The swinging cylinder 54 has a vertical axis and is positioned on the right-hand side of the right lower furnace 15. The swinging cylinder 54 has an upper rear end pivotally joined by a bracket 56 to a frame 55 which is fixed to a right side surface of the right lower furnace 15, and a piston rod 54*a* pivotally connected to a right rear end of the swinging arm 50.

When the hands 52 are closed by the opening/closing cylinder 53 while the swinging arm 50 is being angularly moved to move the hands 52 toward the flanges 9, 10, lower distal ends of the flanges 9, 10 are gripped by and between upper distal ends of the hands 52. Specifically, clamp seats 48 (see also FIG. 2) are fixed through thermally insulating members 47 to the lower distal ends of the flanges 9, 10, and therefore, the upper distal ends of the hands 52 grip the flanges 9, 10 through the thermally insulating members 47 and the clamp seats 48.

The flanges 11, 12 extending horizontally from the side mating surfaces of the lower dies 4, 5 can be clamped by clamping means (not shown) which are identical to the clamping means 23, 24.

Operation of the apparatus according to the present invention in a process of shaping a superplastic metal work-piece W will now be described below.

First, the swinging cylinders 43 of the clamp means 23 are actuated to cause the swinging arms 44 to move the hands 42 away from the sets of the flanges 7, 8, and the cylinder 36 of the lifting/lowering means 22 is actuated to cause the block 35 and the joint arm 37 to elevate the upper furnace 13 together with the upper die 3, thereby opening the upper die 3. At this time, the left lower furnace 14 and the left lower die 4 have been moved on the guide rails 25 and joined to the right lower furnace 15 and the right lower die 5, respectively, by the cylinder 30 of the moving means 21. With the hands 52 of the clamping means 24 positioned closely to the flanges 9, 10 of the lower dies 4, 5 by the swinging cylinder 54, the piston rod 54*a* of the opening/closing cylinder 54 is extended to close the hands 52 for thereby gripping the flanges 9, 10 between the upper distal ends of the hands 52 through the thermally insulating members 47 and the clamp seats 48. The flanges 11, 12 on the side surfaces of the lower dies 4, 5 are also clamped by the non-illustrated clamping means. The lower dies 4, 5 are now fully clamped together.

Then, the superplastic metal workpiece W is supported on the upper surfaces of the lower dies 4, 5 with the boss "a" positioned in the cavity 6 in the lower dies 4, 5. The upper furnace 13 and the upper die 3 are lowered by the cylinder 36 until the upper furnace 13 and the upper die 3 are joined to the lower furnaces 14, 15 and the lower dies 4, 5, respectively. The upper die 3 and the lower dies 4, 5 are now fully combined into the shaping die assembly 1 with the superplastic metal workpiece W held in the shaping die assembly 1. At the same time, the upper furnace 13 and the lower furnaces 14, 15 are also fully combined into the furnace assembly 2 which is substantially in the form of a box. The die assembly 1 is housed in the furnace assembly 2 except for the flanges 7, 8, 9, 10, 11, 12, and the outer surfaces of the shaping die assembly 1 are therefore surrounded in their substantial entirety by the furnace assembly 2.

Thereafter, the swinging cylinders 43 of the clamping means 23 are actuated to swing and move the hands 42 toward the respective sets of the flanges 7, 8. The piston rods 41*a* of the opening/closing cylinders 41 are extended to close the hands 42 for thereby gripping the flanges 7, 8 between the upper distal ends of the hands 42 through the thermally insulating members 47 and the clamp seats 48. The upper die and the lower dies 4, 5 are now hermetically clamped by the clamping means 23, 24.

The heaters 18 on the inner wall surfaces of the furnace assembly 2 are energized to heat the furnace assembly 2 and the superplastic metal workpiece W held therein up to a suitable temperature. Since the shaping die assembly 1 is housed in its substantial entirety within the furnace assembly 2 whose inner wall surfaces are composed of the thermally insulating members 17 and the flanges 7~12 projecting out of the furnace assembly 2 are gripped by the hands 42, 52 through the thermally insulating members 47, the heat is prevented from being dissipated or radiated from the shaping die assembly 1 through the hands 42, 52 to the clamping means 23, 24. Consequently, the shaping die assembly 1 and the superplastic metal workpiece W can efficiently be heated up to and kept at a desired temperature.

While the superplastic metal workpiece W is being thus heated, a pressurized gas is introduced from the supply pipe 19*a* through the gas inlet hole 19 into the shaping die assembly 1 to deform the boss "a" of the superplastic metal workpiece W complimentarily to the shape of the cavity 6, thereby forming a product of a desired shape in the cavity 6.

Thereafter, the hands 42 of the clamping means 23 are opened or released from the flanges 7, 8 by the opening/closing cylinders 41. After the hands 42 of the clamping means 23 are released from the flanges 7, 8, the upper furnace 13 and the upper die 3 are lifted by the lifting/lowering means 22, thus opening the upper die 3. The hands 52 of the clamping means 24 are opened or released from the flanges 9, 10 by the opening/closing cylinder 53, and the moved away from the flanges 9, 10 by the swinging cylinder 54. The flanges 11, 12 are also released from corresponding hands (not shown) by the non-illustrated clamping means. The cylinder 30 of the moving means 21 is actuated to move the left lower furnace 14 and the left lower die 4 to the left away from the right lower furnace 15 and the right lower die 5, thus opening or separating the lower dies 4, 5. Now, the shaped product is removed from the cavity 6 in the separated lower dies 4, 5.

Because the furnace assembly 2 with the heaters 18 therein and the shaping die assembly 1 are essentially separate from each other, the shaping die assembly 1 can be reduced in size. Since the furnace assembly 2 has its inner wall surfaces composed of the thermally insulating members 17 and heats the shaping die assembly 1 housed therein, the furnace assembly 2 can heat the superplastic metal workpiece W efficiently and uniformly even if the furnace assembly 2 is relatively small in size. The die assembly 1 is clamped by the clamping means 23, 24 which grip the flanges 7~12. This fact, together with relative small sizes of the furnace assembly 2 and the shaping die assembly 1, makes it possible to reduce the sizes of the lifting/lowering means 22 and the moving means 21 which join and separate the upper die 3 and the lower dies 4, 5. As a consequence, the apparatus according to the present invention can be small in size and can be manufactured inexpensively.

Removability of the furnace assembly 2 from the shaping die assembly 1 allows the shaping die assembly 1 to be replaced with another flanged die assembly designed for shaping products of a different type or shape. Even when the shaping die assembly 1 is replaced, the furnace assembly 2, the lifting/lowering means 22, the moving means 21, and other mechanisms can be used with the new die assembly. Consequently, the apparatus according to the present invention is adaptable easily and inexpensively to the manufacture of products of different types or shapes.

In the illustrated embodiment, the thermally insulating members 47 and the clamp seats 48 through which the flanges 7~12 are gripped by the clamping means 23, 24 are fixed to the flanges 7~12. However, the thermally insulating members 47 and the clamp seats 48 may be mounted on the clamping means.

Although a certain preferred embodiment of the present invention has been shown and described in detail, it should be understood that various changes and modifications may be made therein without departing from the scope of the appended claims.

What is claimed is:

1. An apparatus for shaping a workpiece of a superplastic metal, comprising:

a shaping die assembly for holding the workpiece therein to shape the workpiece with a pressurized gas while the workpiece is being heated, said shaping die assembly comprising a plurality of dies separable from and joinable to each other, said dies having flanges extending from mating surfaces thereof;

a furnace assembly surrounding outer surfaces of said dies, said furnace assembly comprising a plurality of furnaces separable from and joinable to each other, said furnaces being detachably mounted on said dies, respectively, said shaping die assembly being housed in said furnace assembly with said flanges projecting out of said furnace assembly when said dies are joined to each other;

heating means for heating said shaping die assembly, said heating means being mounted on inner wall surfaces of said furnaces in a space defined between said furnace assembly and said shaping die assembly; and clamping means for gripping said flanges while the workpiece is being held between said dies which are joined to each other.

2. The apparatus according to claim 1, wherein said clamping means comprises means for gripping said flanges through thermally insulating members.

3. The apparatus according to claim 1, wherein said inner wall surfaces of said furnaces comprise thermally insulating members.

4. The apparatus according to claim 1, wherein said clamping means comprises:

a pair of openable and closable hands movable toward and away from said flanges projecting out of said furnace assembly when said dies are joined to each other;

advancing/retracting means for moving said hands toward said flanges; and opening/closing means for closing said hands to grip said flanges when said hands are moved toward said flanges into a position in which to grip said flanges therebetween.

5. The apparatus according to claim 1, wherein said dies include:

a pair of lower dies which are horizontally separable away from and joinable to each other; and an upper die which is vertically separable away from and joinable to said lower dies, further comprising:

lower die actuating means for horizontally moving at least one of said lower dies together with the furnace which is mounted on said at least one of the lower dies until said lower dies are separated from or joined to each other; and upper die actuating means for vertically moving said upper die together with the furnace which is mounted on said upper die toward said lower dies until said upper die and said lower dies are separated from or joined to each other.

* * * * *